US006925931B2

(12) United States Patent
Korhonen

(10) Patent No.: US 6,925,931 B2
(45) Date of Patent: Aug. 9, 2005

(54) METHOD AND APPARATUS FOR MARKING OBJECTS IN A PILE

(75) Inventor: Antti Korhonen, Lahti (FI)

(73) Assignee: Metso Panelboard Oy, Nastola (FI)

( * ) Notice: Subject to any disclaimer, the term of this patent is extended or adjusted under 35 U.S.C. 154(b) by 0 days.

(21) Appl. No.: 10/478,133

(22) PCT Filed: May 21, 2002

(86) PCT No.: PCT/FI02/00432

§ 371 (c)(1),
(2), (4) Date: Feb. 20, 2004

(87) PCT Pub. No.: WO02/094570

PCT Pub. Date: Nov. 28, 2002

(65) Prior Publication Data

US 2004/0159253 A1 Aug. 19, 2004

(30) Foreign Application Priority Data

May 21, 2001 (FI) ..... 20011064

(51) Int. Cl.[7] ..... B41F 17/00

(52) U.S. Cl. ..... 101/35; 101/4; 101/18; 101/43; 414/790; 414/790.2; 414/790.5; 414/788.1; 414/788.9

(58) Field of Search ..... 101/35, 4, 18, 101/43; 414/790, 790.2, 790.5, 788.1, 788.9

(56) References Cited

U.S. PATENT DOCUMENTS

| | | | | |
|---|---|---|---|---|
| 1,715,167 A | | 5/1929 | McDonough | |
| 4,043,458 A | * | 8/1977 | Schott, Jr. | 414/789 |
| 4,324,519 A | | 4/1982 | Moore | |
| 4,437,655 A | * | 3/1984 | Bijttebier et al. | 83/30 |
| 5,249,917 A | * | 10/1993 | Neumann et al. | 414/799 |
| 5,775,397 A | * | 7/1998 | Lippincott | 144/356 |
| 6,146,084 A | * | 11/2000 | Doyle | 414/788.9 |
| 6,529,799 B1 | * | 3/2003 | Paulk et al. | 700/227 |

* cited by examiner

*Primary Examiner*—Andrew H. Hirshfeld
*Assistant Examiner*—Andrea H. Evans
(74) *Attorney, Agent, or Firm*—Birch, Stewart, Kolasch & Birch, LLP

(57) ABSTRACT

A method and an apparatus for making e.g. boardlike objects (11) arranged in a pile (12), in which method the objects are marked with a marking printed by a print head (26) and containing e.g. information about the object. To improve the marking quality, the objects are pressed together to reduce or eliminate gaps between them in the direction of compression, and the marking is made on an edge of the object that is parallel to the direction of compression of the objects.

11 Claims, 1 Drawing Sheet

METHOD AND APPARATUS FOR MARKING OBJECTS IN A PILE

CROSS-REFERENCE TO RELATED APPLICATION

This application is the national phase under 35 U.S.C. § 371 of PCT International Application No. PCT/FI02/00432 which has an International filing date of May 21, 2002, which designated the United States of America.

BACKGROUND OF THE INVENTION

1. Field of the Invention

The present invention relates to a method and to an apparatus for marking e.g. boardlike objects in a pile.

2. Description of Background Art

In the manufacture of various board products, such as e.g. chipboards, the board may be provided with a marking giving information such as manufacturer, type, date of manufacture of the board or the like. There are systems in which such a marking is made in an individual board, e.g. on an edge of the board. Systems are also known in which the marking is made on the edge of the boards while the boards are in a pile. The marking is produced using e.g. an ink jet print head or equivalent.

A drawback regarding the marking of boards is that the piles of boards may have air gaps between boards due e.g. to bending of the boards, a consequence of which is e.g. that the text is not always printed in the right place in the printing area and that the printing ink used for the marking may spread between the boards, staining the surface of the product. Because of the gaps, the height dimension of the pile is undeterminable.

SUMMARY AND OBJECTS OF THE INVENTION

The object of the present invention is to achieve a new type of method and apparatus for marking objects in a pile that make it possible to avoid the drawbacks of prior art.

The invention is mainly characterized in that, according to the invention, the boards in the pile of boards are pressed together especially to eliminate errors caused by air gaps between the boards. In a solution according to the invention, pressure is applied from the top of the pile of boards by using a pressing element that compresses the pile of boards by its own weight. In this situation, the pile is e.g. on a conveyor at a marking station.

In more definite terms, the invention is characterized by what is presented in the claims.

The invention makes it possible to achieve a substantial improvement of the print quality. In addition, the invention allows the pile height to be more accurately determined in the printing station because air gaps between boards have been eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail by the aid of an embodiment example with reference to the attached drawings, wherein.

DETAILED DESCRIPTION OF THE PREFERRED EMBODIMENTS

Figure 1:
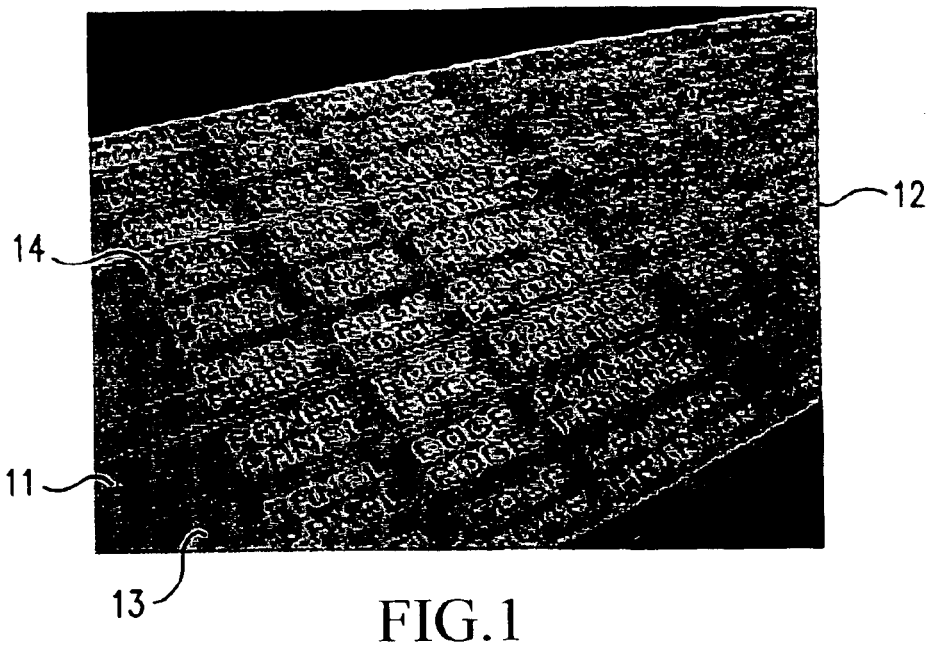
FIG. 1 presents a pack of boards provided with a marking on one edge of the boards.

FIG. 1 shows chipboards 11 arranged one over the other as a pile 12. Printed on an edge 13 of each board 11 is a marking 14 consisting of information such as type, size, manufacturer, date of manufacture of the board and similar data. The pile 12 of boards may consist of a plurality of boards placed on top of each other, and its height may typically be e.g. about 1 m. In addition, the pile may comprise e.g. protective boards placed under and over it.

Figure 2:
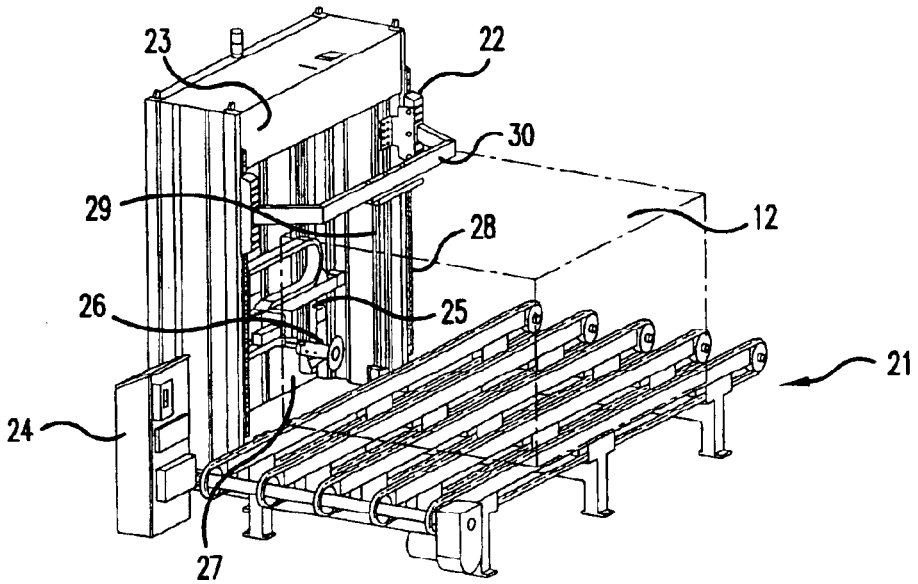
FIG. 2 presents a marking station comprising a pressing device according to the invention.

The pile of boards 12 is brought e.g. on a chain conveyor 21 (FIG. 2) to a marking station 22, where a marking as shown in FIG. 1 is made on the edge of each board. The station consists of a frame part 23, a printer unit 24 controlling the printing, and a system, e.g. a PLC system (not shown in the figure) used for controlling the movable parts of the marking station. Fitted in the frame part 23 are guide bars 25 permitting motion in the directions of the three principal axes x, y, z, with a print head 26, e.g. an ink jet print head fitted on the guide bars, and actuators 27 for moving and guiding the print head in directions x, y, z at a suitable short distance from the edge of the pile 12 e.g. during a marking operation.

In addition to this, the frame part is provided with vertical guide bars 28 with a pressing element 30 fitted on them and moved vertically by means of an electric motor drive and cogged belts 29. The pressing element 30, typically weighing 100–150 kg, compresses the pile of boards from above in its edge area while the pile is on the conveyor. For this purpose, the electric drive is provided with a freewheel clutch mounted e.g. on its shaft, allowing the pressing element 30 to be first lowered with a restrained movement against the upper surface of the pack of boards 12 and then released so that it exerts a pressure on the pile of boards by its own weight. The movements of the pressing element are controlled by the control unit (not shown in the figure).

It is obvious to the person skilled in the art that the invention is not limited to the embodiment described above, but that it may be varied within the scope of the following claims. The compression of the pile of boards can also be effected using e.g. a hydraulic or pneumatic cylinder or similar actuating devices and their combinations. The pack of boards may also be compressed e.g. by placing a fixed stop above the pack and lifting the pack from below against the top stop e.g. by means of a scissor table. The pack may also be compressed by pressing it simultaneously from both the lower and upper surfaces and so on. The sphere of application of the invention is not limited to boardlike objects; instead, it can also be applied in the case of other objects of suitable shape.

What is claimed is:

1. A method for marking objects arranged in a pile, comprising the steps of:

pressing together and compressing the objects in the pile from above by means of a weight of a pressing element;

marking the objects with a marking printed by a print head, the marking containing information about the objects, wherein the pressing step reduces or eliminates gaps between the objects in the direction of compression, and wherein the marking step makes the marking on an edge of the objects that is parallel to the direction of compression of the objects.

2. The method according to claim 1, wherein in the pressing step a pressing element is moved vertically by a motor drive, which, using a freewheel clutch, is caused to release the pressing element upon reaching an upper surface of the pile.

3. The method for marking objects according to claim 1, wherein the objects are boards.

4. An apparatus for marking objects arranged in a pile, comprising:

a pressing unit for compressing the objects to reduce or eliminate gaps between the objects in a direction of compression in order to improve marking quality; and a print head for marking the objects with a marking containing information about the objects, wherein the pressing unit includes a pressing element for pressing the pile from above by its own weight, and wherein the print head is fitted to make the marking on edges of the objects that are parallel to the direction in which the objects are compressed.

5. The apparatus according to claim 4, further comprising:

vertical guide bars on which the pressing element is mounted; and a motor drive, by means of which the pressing element is moved vertically along the guide bars, the motor drive being provided with a freewheel clutch by means of which the pressing element is released upon reaching an upper surface of the pile.

6. The apparatus according to claim 4, wherein the pressing unit is a press beam.

7. The apparatus for marking objects according to claim 4, wherein the objects are boards.

8. An apparatus for marking objects arranged in a pile, comprising:

a pressing unit having a pressing element for compressing the objects to reduce or eliminate gaps between the objects in a direction of compression in order to improve marking quality;

vertical guide bars on which the pressing element is mounted;

a motor drive, by means of which the pressing element is moved vertically along the vertical guide bars, the motor drive being provided with a freewheel clutch by means of which the pressing element is released upon reaching an upper surface of the pile; and a print head for marking the objects with a marking containing information about the objects, wherein the print head is fitted to make the marking on edges of the objects that are parallel to the direction in which the objects are compressed.

9. The apparatus for marking objects according to claim 8, wherein the pressing unit includes a pressing element for pressing the pile from above by its own weight.

10. The apparatus for marking objects according to claim 8, wherein the pressing unit is a press beam.

11. The apparatus for marking objects according to claim 8, wherein the objects are boards.

* * * * *